US005884812A

United States Patent [19]

Stawowski

[11] Patent Number: 5,884,812

[45] Date of Patent: Mar. 23, 1999

[54] TUBE SQUEEZER

[76] Inventor: Jan-Piotr Stawowski, 2327 N. Normandy Ave., Chicago, Ill. 60707

[21] Appl. No.: 891,806

[22] Filed: Jul. 14, 1997

[51] Int. Cl.[6] ..... B65D 35/32

[52] U.S. Cl. ..... 222/100

[58] Field of Search ..... 222/99, 100

[56] References Cited

U.S. PATENT DOCUMENTS

| | | | |
|---|---|---|---|
| Re. 27,689 | 6/1973 | Hausmann et al. | 222/100 |
| 2,054,990 | 9/1936 | Newton et al. | 222/99 |
| 2,652,950 | 9/1953 | Major | 222/100 |
| 2,896,822 | 7/1959 | Songer | 222/99 |
| 3,525,457 | 8/1970 | Hausmann et al. | 222/100 |
| 3,885,708 | 5/1975 | Parry | 222/100 |
| 3,910,460 | 10/1975 | Hausmann et al. | 222/99 |
| 3,920,157 | 11/1975 | Yeung | 222/100 |
| 4,301,945 | 11/1981 | Dworkin | 222/100 |
| 4,576,314 | 3/1986 | Elias et al. | 222/99 X |
| 5,058,771 | 10/1991 | Curtis | 222/99 |
| 5,102,014 | 4/1992 | Yanagisawa et al. | 222/99 X |
| 5,215,223 | 6/1993 | Lee | 222/100 |
| 5,263,610 | 11/1993 | Okamura et al. | 222/100 |
| 5,480,065 | 1/1996 | Powers | 222/99 |
| 5,642,839 | 7/1997 | Lee | 222/99 |

FOREIGN PATENT DOCUMENTS

| | | | |
|---|---|---|---|
| 114347 | 12/1941 | Australia | 222/100 |
| 212770 | 5/1960 | Australia | 222/100 |
| 598560 | 12/1925 | France | 222/100 |
| 2803031 | 8/1978 | Germany | 222/99 |
| 218786 | 12/1941 | Switzerland | 222/100 |
| 2113172 | 8/1983 | United Kingdom | 222/100 |

*Primary Examiner*—Kenneth Bomberg
*Attorney, Agent, or Firm*—Richard C. Litman

[57] ABSTRACT

An economical and ergonomical three-part tube squeezer for collapsible tubes containing viscous fluids, the squeezer including an elliptically shaped housing, a shaft rotatably mounted in the housing and having a longitudinal slot therethrough to receive the end of a tube and wind the tube therearound, a key outside the housing on an end of the shaft, for winding the shaft, and a removable (friction-fit or threaded) locking piece on the other end of the shaft, outside the housing, for holding the structure in assembly. The tube squeezer is self-standing and operated while in the standing position or held in one's hand. The tube squeezer rolls up the collapsible tube by the key to dispense the viscous fluid contents upwardly when in the standing position. The tube squeezer can be disposed with the collapsible tube or reused with another tube.

8 Claims, 1 Drawing Sheet

TUBE SQUEEZER

BACKGROUND OF THE INVENTION

1. Field of the Invention

The present invention relates to an economical disposable self-standing, wind up generic tube squeezer.

2. Description of the Related Art

The related art describes various tube squeezers, some of which appear to be similar. However, in this crowded art, there are significant differences between the related art devices and the present invention which will be pointed out. The pertinent art of interest will be discussed in the order of their perceived relevance to the present invention.

Austria Patent No. 212,770 issued on May 15, 1960, describes a three-part standing tube squeezer having a housing which is triangular in cross-section with an open top and bottom. The grip knob is attached to a slotted roller having a head at the opposite end. A tethered cap is attached to the holder at some point as best understood. A significant difference resides in the construction of the roller and grip knob vis-a-vis the detachable locking guard piece which permits the versatility of being able to remove the keyed shaft from the housing for replacement if deemed necessary for repair in the present invention. Another significant difference resides in the ergonomic shape of the housing of the present invention which permits hand-holdable use.

U.S. Pat. No. 3,920,157 issued on Nov. 18, 1975, to Yim-Hei J. Yeung describes a standing plastic tube squeezing device consisting of three parts. The housing is asymmetrically shaped with the flat front wall having an open slot leading to the front opening. The front opening leads into an integrated hollow cylindrical portion or tube which has an aperture in the flat rear wall for the end of the keyed shaft. The keyed end of the hollow shaft has an annular step on a disc. The shaft has a slot which extends from the stepped end to the opposite end of the shaft which is flared and snapped into place. It is believed that the strain of winding up the collapsed tube portion would be destructive on the flared and slotted end of the shaft. The differences in the structures between the devices of the reference and the present invention are as follows: (1) The opening for the tube in the housing extends from the side opening for the handle up to the top which results in weakness of the housing; (2) The shaft is enclosed in a cylinder which limits the volume of flattened tube being wound; (3) The device must be made of flexible plastic which will exclude a metal composition; and (4) The tube end is inserted in the extended slot of the shaft before insertion of the shaft into the housing.

U.S. Pat. No. 5,215,223 issued on Jun. 1, 1993, to Sang S. Lee describes a squeezing and dispensing device for a toothpaste tube. A trapezoidal shaped housing has a winding key with a gear holder for a slotted shaft attached to the winding key with an inner annular gear and an outer threaded handle. The toothpaste tube is inserted from a side opening and into the slot of the shaft. The rotation of the winding key is held by a gear holder spring with an external push button for release of the spring. The dispensing device is similar in concept but overly equipped with gearing and a rachet pawl release. The present invention is inexpensive to manufacture and can be disposed with the empty toothpaste or the like tube still inside the holder-squeezer device.

U.S. Pat. No. 4,301,945 issued on Nov. 24, 1981, to Eugene Dworkin describes a standing toothpaste dispenser made from resilient Lucite (TM) plastic. A W-shaped retainer clip is maintained within a pyramidal housing with mouth-forming opposite side walls and opposite open regions. A key on a partially slotted pin traps the crimped end of the tube and maintains the rolled up tube end between the side walls and the retainer clip. The dispenser structure bears little resemblance to the present invention except for the winding key. There is no suggestion for holding the dispenser in one's hand for depositing the viscous fluid on other materials.

U.S. Pat. No. 3,525,457 issued on Aug. 25, 1970 and reissued as Re. 27,689 on Jun. 26, 1973, to Else Hausmann et al. describe a device for holding and emptying tubes similar to the device of Dworkin. The notable differences are the addition of a plate spring which snap-fits into the housing below the shaft and the key handle is cylindrically shaped. The base can be equipped with a magnet or a suction cup. The resulting structure is seen to be clearly distinguishable from the present invention.

U.S. Pat. No. 2,652,950 issued on Sep. 22, 1953, to Frederick A. Major describes a holder and dispenser for a collapsible tube consisting of a hinged tube holding bracket on a fixed base. The bracket is tipped by means of a finger grip to insert the tube end into a slot of the shaft, and the bracket is returned to a vertical position. The tube contents are dispensed by utilizing an elongated operating arm oscillating a ratchet wheel attached to the shaft. The device has manifold parts which would distinguish this reference from the present invention.

U.S. Pat. No. 5,263,610 issued on Nov. 23, 1993, to Naomi Okamura et al. describes a tool for squeezing out high-viscosity liquid from a tube container consisting of a rectangular hollow holder body with apertured circular bearing end portions for holding a tubular slotted spool shaft with a wing handle. The bearing end portions can be opened in the rear similar to a box wrench head with teeth which engage projecting teeth or a localized roughened surface of the spool shaft. Slits are provided in the apertures of the bearing portions for spool shaft. There are no holding means for the spool shaft on either end which together with the predominantly open housing would distinguish this two-piece device from the present invention.

Australia Patent Application No. 114,347 published on Dec. 18, 1941, for Walter Ellis et al. describes a wall hung collapsible tube expressing bracket with cheeks and a forward curved lower portion. The cheeks hold a restraining bar and a keyed shaft. The shaft can have legs unequal in length to hold the tube end or configured as a stem with turned over sides to engage the tube end. The three-part structure with its holding rod and forward curved lower portion is distinguished by its clear difference as compared to the present invention.

France Patent Application No. 598,560 published on Dec. 19, 1925, for an apparatus for use with tubed products. An open curved bracket with apertures on the top and bottom flanges anchor the device on a wall. A handle on a slotted spindle winds up the toothpaste tube while the toothpaste is squeezed out downwardly. There is no suggestion for modifying this device to be free standing.

United Kingdom Patent Application No. GB 2,113,172 A published on Aug. 3, 1983, for Joseph W. Hurley describes a wall-mounted toothpaste dispenser which is a box with an aperture on top for the nozzle. A knobbed spindle on the bottom resting in vertical slots winds up the tube squeezing out the toothpaste. A full front cover permits access to the interior of the box. There is no suggestion for a free standing dispenser.

None of the above inventions and patents, taken either singularly or in combination, is seen to describe the instant invention as claimed. Thus a tube squeezer solving the aforementioned problems is desired.

SUMMARY OF THE INVENTION

The present invention is an economical three-part tube squeezer for collapsible tubes containing viscous fluids such as toothpaste, adhesive, grease, sealant, cream, paste, cake decorating composition, and the like. The tube squeezer is self-standing and operated while in the standing position or held in one's hand. The tube squeezer rolls up the collapsible tube by a key to dispense the viscous fluid contents upwardly when in the standing position. The tube squeezer can be disposed with the collapsible tube or reused with another tube.

Accordingly, it is a principal object of the invention to provide an economical optionally disposable tube squeezer for dispensing the viscous liquid contents.

It is another object of the invention to provide a tube squeezer which is self-standing and yet can be held in hand.

It is a further object of the invention to provide a tube squeezer which is simple to operate and repair.

Still another object of the invention is to provide a tube squeezer for dispensing toothpaste, adhesive, grease, sealant, cream, paste, cake decorating compositions, and the like.

It is an object of the invention to provide improved elements and arrangements thereof in a tube squeezer for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
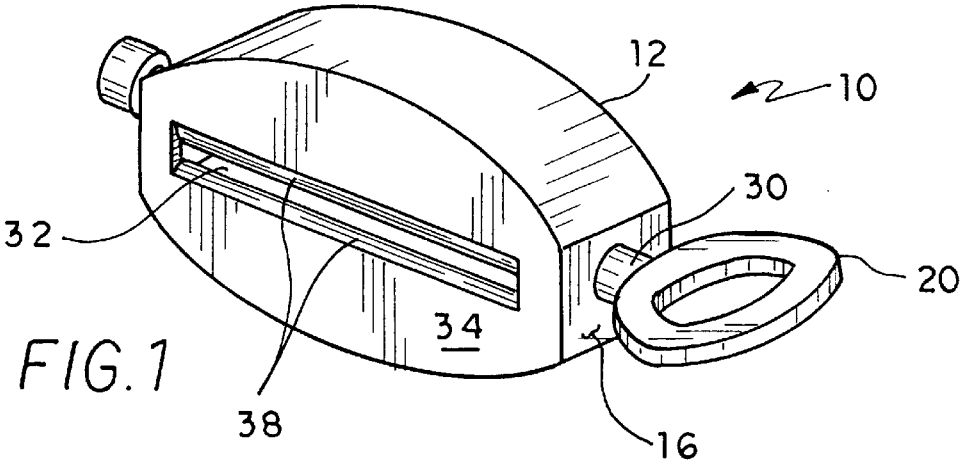
FIG. 1 is a perspective front view of the ergonomically shaped tube squeezer device according to the present invention showing the distinctive and functional rounded lips aligned with the slot.
Figure 2:
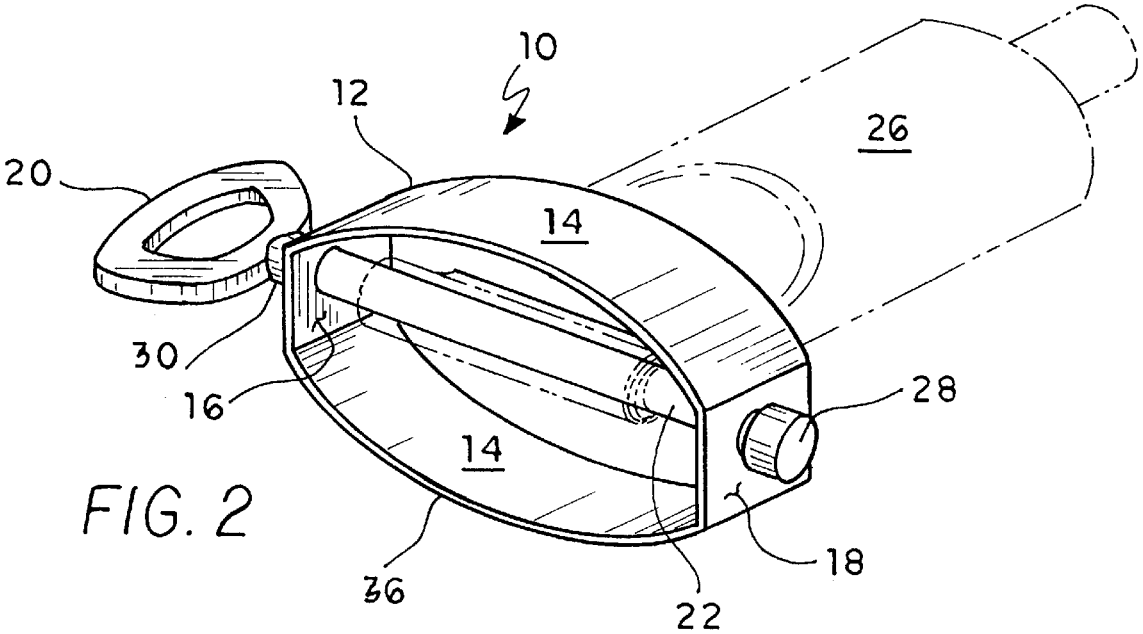
FIG. 2 is a rear view of the tube squeezer device with a collapsible tube partially squeezed onto the roller shaft.
Figure 3:
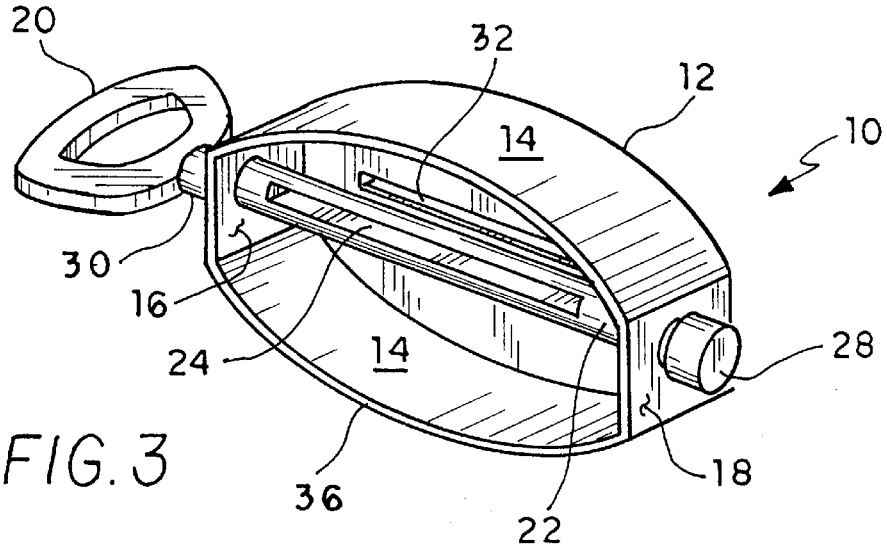
FIG. 3 is a rear view of the tube squeezer device showing the open bottom.

The present invention is directed to FIGS. 1–3 illustrating an economical throw-away tube squeezer device 10 which is self-standing for taking minimal space on a bathroom counter or sink and ergonomically shaped for holding in one's hand. It is made up of only three parts preferably made of plastic of various colors. The housing 12 as a first part is elliptically shaped with opposite curvilinear sides 14 and flat sides 16 (key side) and 18. The shape of the housing 12 is considered an important feature as being ergonomically suitable for holding in one's hand. The second part is a key 20 integrated with a shaft 22 having a longitudinal slot 24 for inserting the flattened end of a tube 26 (in shadow) of a viscous fluid, e.g., toothpaste. The third part is a locking guard piece 28 which is either friction fitted or threaded onto the shaft 22. The shaft 22 has a thickened portion or shoulder 30 next to key 20 which provides the trapping of the shaft 22 with the assistance of the locking guard piece 28 to maintain the shaft 22 securely in one position, i.e., not shifting from side to side, relative to the housing 12.

The housing 12 has a slot 32 on its top surface 34 and an open bottom 36. The slot 32 has rounded lips 38 (with the distance between increasing from the inside to the outside surface) which perform the following important functions of: (1) enhancing the squeezing or flattening operation of the tube 26; (2) protecting the vulnerable slot 32 from cracking due to its rounded surface; and (3) accentuating a smooth gradual pressure on the entering tube. The open bottom 36 permits the insertion of the flattened end of the tube 26 in the slot 24 of the shaft 22 and subsequent removal of the empty tube 26 by unwinding the flattened tube from the shaft 22.

The winding process results in greater stability of the device 10 due to the lower center of gravity. The device is light in weight when made of plastic and can be disposed of with the empty tube 26 if desirable. It is also contemplated that the device 10 can be used repeatedly and can be made of heavier metal parts. Finally, the device is versatile and can be operated in the hand for dispensing the viscous fluid.

Thus, the present invention provides a simplified and economical tube squeezer device 10 with a minimum of three parts which can be replaced individually by any user if required. The cost of manufacturing the present invention can be appreciated as being minimal compared to the devices of the related art. Finally, the present invention is simple to operate even by children and aged people.

It is within the ambit of the present invention to squeeze tubes containing various viscous fluids such as toothpaste, glue, paste cream, caulk, grease, cake decorating compositions, and the like.

It is to be understood that the present invention is not limited to the embodiments described above, but encompasses any and all embodiments within the scope of the following claims.

I claim:

1. A three-part, ergonomical, self-standable tube squeezer device comprising:

an elongated housing as a first part having opposite curvilinear sides separated by first and second flat sides, a flat top surface with a centered longitudinal slot, and an open flat bottom; said first flat side having a first aperture and said second flat side having a second aperture;

an elongated shaft as a second part with a longitudinal slot coextensive in length and width with said centered longitudinal slot in said top surface, and having an integral winding key on a first end, said shaft being positioned to project the winding key from said first aperture and outside the housing; and a locking guard piece as a third part for fitting an opposite second end of the shaft for maintaining the position of the shaft within the housing, whereby a collapsible tube containing viscous liquid can be dispensed by inserting an end of the tube into the centered longitudinal slot in the housing and into the coextensive slot in the shaft to squeeze the viscous liquid from the tube by turning the key and winding the emptying tube around the shaft.

2. The tube squeezer device according to claim 1, wherein the elongated slot in the housing has coextensive externally smooth rounded lips for enhancing the flattening operation of the tube.

3. The tube squeezer device according to claim 2, wherein the distance between the lips increases from the inside to the outside surface of the housing.

4. The tube squeezer device according to claim 1, wherein the locking guard friction fits the second end of the shaft.

5. The tube squeezer device according to claim 1, wherein the locking guard threadably fits the second end of the shaft.

6. The tube squeezer device according claim 1, wherein the three parts are plastic.

7. The tube squeezer device according to claim 1, wherein the three parts are metal.

8. The tube squeezer device according to claim 1, wherein the elongated and slotted shaft has an increased diameter contiguous to the key outside the housing for securing the shaft from moving longitudinally.

* * * * *